United States Patent [19]

Stern

[11] 4,060,800

[45] Nov. 29, 1977

[54] FIRE ALARM DEVICE

[76] Inventor: Philip Stern, 200 E. 27th St., New York, N.Y. 10016

[21] Appl. No.: 602,636

[22] Filed: Aug. 7, 1975

Related U.S. Application Data

[63] Continuation of Ser. No. 136,093, April 21, 1971, abandoned.

[51] Int. Cl.[2] ..... G08B 21/00

[52] U.S. Cl. ..... 340/304

[58] Field of Search ..... 340/304; 200/61.62; 317/141 R

[56] References Cited

U.S. PATENT DOCUMENTS

| | | | |
|---|---|---|---|
| 934,878 | 9/1909 | Bastedo | 340/304 |
| 3,886,536 | 5/1975 | Mann | 340/304 |
| 3,887,537 | 5/1975 | Mann et al. | 340/304 |

*Primary Examiner*—Harold I. Pitts

*Attorney, Agent, or Firm*—Wolder & Gross

[57] ABSTRACT

Fire alarm device disposed within a booth having a door, the fire alarm device being operable only when the door of the booth is closed by the person operating the device. Upon the actuation of the fire alarm, the door of the booth is locked for a predetermined length of time, and a signal light visible outside the booth is actuated so as to alert passers-by and/or policemen to the fact that the fire alarm has been pulled. The time delay period during which the person operating the alarm is confined in the booth is sufficient to prevent his making an immediate get-away. This increases the chances of his being caught, should the alarm be a false one, after the door has again been permitted to open to release him from the booth. It also encourages the alarm operator to remain in the vicinity of the alarm box, when the alarm is legitimate, so that he may direct the fire apparatus to the fire.

12 Claims, 5 Drawing Figures

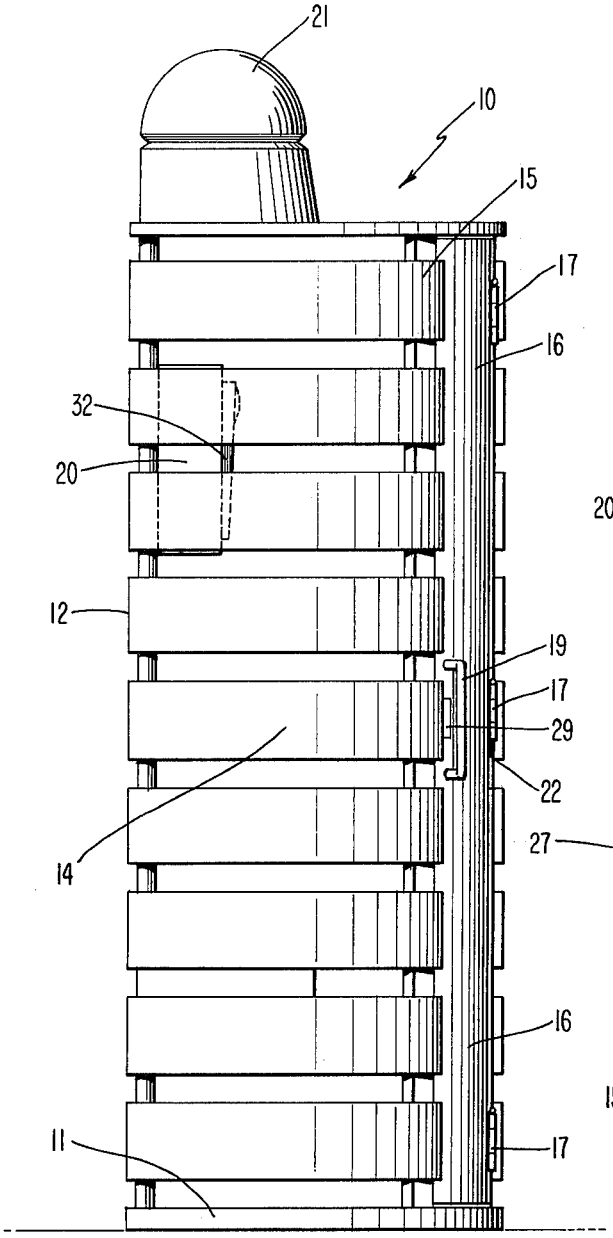
Fig. 1
Fig. 2
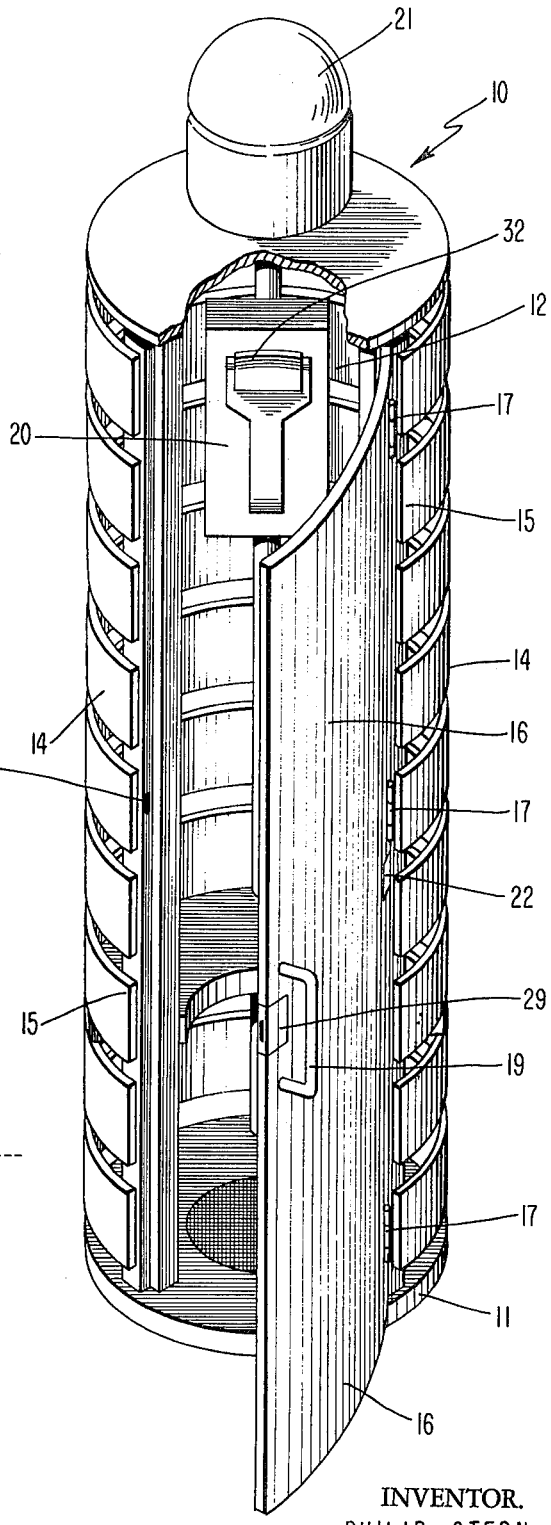
INVENTOR.
PHILIP STERN
BY
Alfred W. Dibber
ATTORNEY

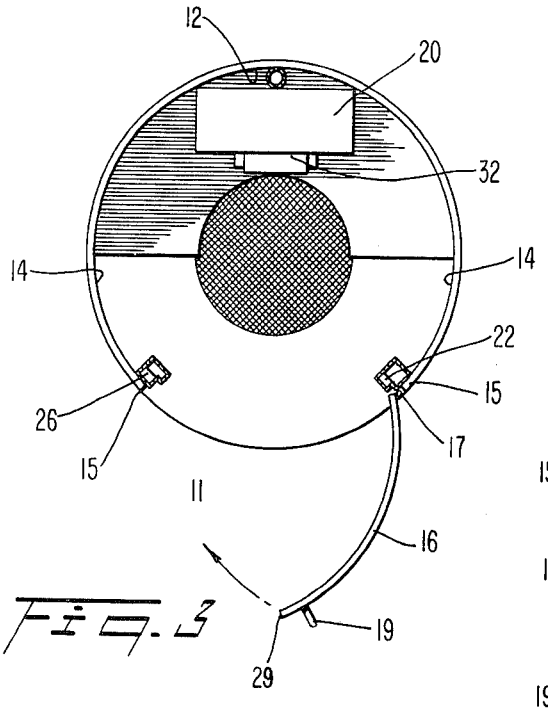
Fig. 3
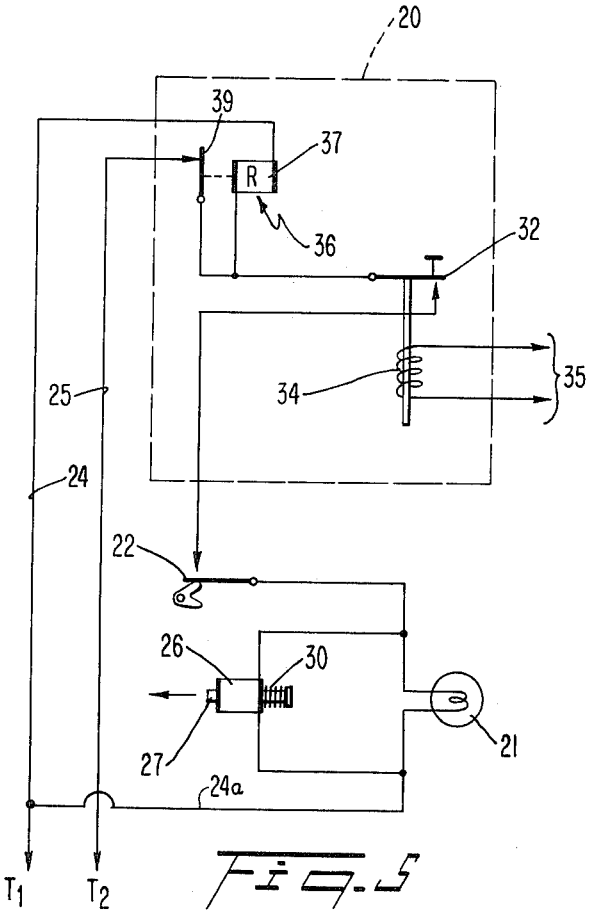
Fig. 5
Fig. 4
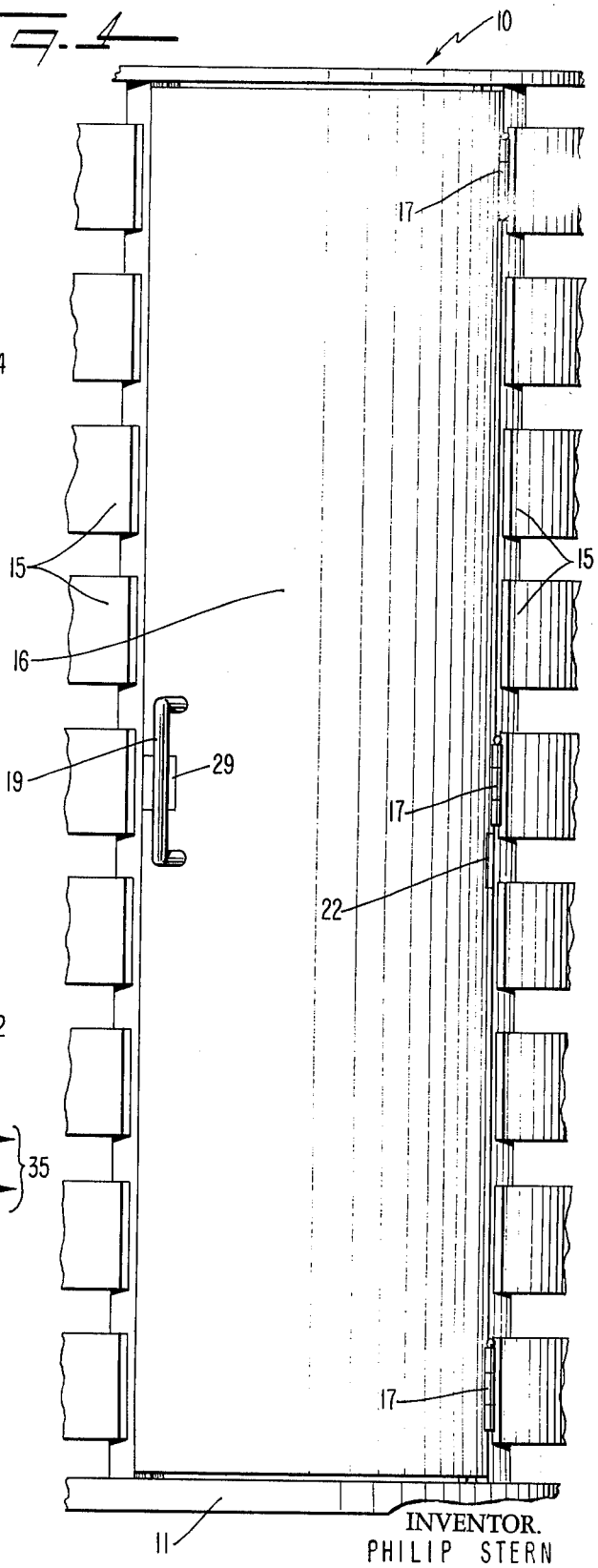
INVENTOR.
PHILIP STERN
BY
Alfred W. Vibber
ATTORNEY

FIRE ALARM DEVICE

REFERENCE TO RELATED APPLICATION

The present application is a continuation of patent application Ser. No. 136,093, filed Apr. 21, 1971, now abandoned.

BACKGROUND OF THE INVENTION

This invention relates to a fire alarm device, and more particularly to a fire alarm device disposed in a public place for operation by members of the public as required, such device being provided with novel mechanism for temporarily detaining the operator of the alarm device at the fire alarm box.

The concept for the device is based on the recognized premise, and suggested procedure from most American Fire Departments, that upon activation of a public fire alarm call, the caller should wait by the alarm box until the fire engines arrive, in order that he can then direct them to the exact location of the fire. The average person is not aware of this need, and often leaves the alarm box vicinity before the engines arrive. Thus, the firemen are forced to learn by indirect means exactly where the fire is located, generally losing precious time doing so.

The enforced waiting period encompassed within this invention thus serves two purposes: It teaches the need for remaining at the alarm box, and also discourages the potential false-alarmist from activating an alarm from which there is no quick escape route. A bench may be provided within the alarm enclosure for those who prefer sitting during the delaying or waiting period.

SUMMARY OF THE INVENTION

Generally speaking, the fire alarm device of the present invention is disposed in a booth provided with a door, the device being so located in the booth that the operator of the device must enter the booth before he can operate the device. Furthermore, the door is provided with circuit operating means interposed into the circuit of the device, the circuit being such that the door must be securely closed before the fire alarm device can be operated. Upon the actuation of the fire alarm, the door is locked for a predetermined length of time, such as 10 or 15 seconds, and a signal light mounted on the booth and visible from outside is actuated so as to alert passersby and/or policemen to the fact that the fire alarm device has been pulled or is operating. The time delay period during which the fire alarm device operator is confined to the booth, by the locking of the door thereof, is sufficient to prevent his making an immediate get-away, and increases the chances of his being caught, should the alarm be a false one, after the door has again been opened to release him from the booth. It also insures the presence of the alarm operator in the vicinity of the fire alarm box to aid in directing the firemen and/or policemen to the fire.

The fire alarm device of the invention will be more readily understood upon consideration of the accompanying drawings showning a preferred embodiment of the device.

BRIEF DESCRIPTION OF THE DRAWINGS

FIG. 1 is a view in side elevation of a fire alarm booth in accordance with the invention, the booth having a door which is shown closed so as temporarily to confine an operator of the fire alarm signal device within the booth;

FIG. 2 is a view in top perspective of the booth with the door open, a portion of the roof of the booth being shown broken away;

FIG. 3 is a view in plan of the booth with the roof having been removed therefrom and with the door open;

FIG. 4 is in view in front elevation of the door in closed position; and

FIG. 5 is a circuit diagram for the control mechanism of the alarm device of FIGS. 2 and 3.

DESCRIPTION OF THE PREFERRED EMBODIMENT

Turning now to the drawings, there is shown in FIGS. 1–4, inclusive, a booth which is generally designated by the reference character 10, such booth being disposed upon a platform 11 which rests upon the ground or other support. Booth 10 has the body thereof constructed of vertically spaced part circular cylindrical bands or slots 14 which are affixed to vertical rods (one shown). Slots 14 terminate at the front of the booth at vertically aligned edges 15. A part circular cylindrical door 16 is hingedly mounted at 17 upon the front wall of the booth to bridge the opening between ends 15 of the slots or bands 14 thereof. The door 16 is provided with a handle 19 on the outside thereof whereby the door may be readily opened, a similar handle 18 being disposed on the inner surface of the door so that the door may be pulled closed by an operator of the alarm device after he has entered the booth.

A fire alarm box 20 is mounted on the inner end wall 12 of the booth 10. The booth 10 is sufficiently deep that the fire alarm box 20 cannot be reached by a would-be operator standing outside the booth.

One or more pilot lights 21 are disposed on the outer part of the booth (one shown) so that they may be readily seen by the public. The one or more pilot lights 21 are lighted by the closing of the jamb switch 22 mounted at the hinge edge of the door 16 so that such switch is closed when the door is closed and is open when the door is open. The portion of the circuit supplying the one or more pilot lights 21 is energized, by further circuit means to the described, after the operator has entered the booth 10, closed the door 16, and has then operated the fire alarm device 20.

Turning now to FIG. 5, the control circuit for the device is supplied from two terminals $T_1$, $T_2$, connected to a domestic or city electric current source. Connected to terminal $T_1$ is a main or bus wire 24, the circuit having a second main or bus wire 25 which is connected to the terminal $T_2$. Serially interposed in a branch wire 24a connected to wire 24 are the light 21, the contacts of switch 22, the contacts of switch 32, and a contact of switch 39, the other contact of switch 39 being connected to wire 25. The time delay relay 36 has a coil 37 which is connected across wire 24a and wire 25 in parallel with contacts 39.

The door 16 is provided with a safety lock generally designated 26, such safety lock having a coil and a reciprocable plunger 27 operated thereby, the plunger selectively cooperating with an escutcheon plate 29 mounted upon the edge of the door. The coil of the safety lock is connected in parallel with pilot light 21. The safety lock is provided witha coil compression spring (schematically shown at 30 in FIG. 5) which constantly urges the plunger 27 toward its lock-open position. Upon the energization of the coil 26, the plunger 27 is thrust into its lock-closed position, overcoming the opposition of the spring 30.

The above-described fire alarm device operates as follows:

A would-be operator of the fire alarm device 20 enters the booth 10 and shuts the door. Thereupon the normally open jamb switch contacts 22 are closed, readying the pilot light or lights 21 and the safety lock 26 for operation upon the operation of the fire alarm. The operator then operates the fire alarm by pressing a control device, thereby closing the normally open contacts 32. In so doing he sends out a signal through the schematically shown coil device 34 having its terminals 35 connected into the fire alarm system of the city, building, etc. The closing of the contacts 32 energizes the time delay relay coil 37 which then begins to calculate time. It will be understood that the time delay relay 36 may be adjusted throughout a predetermined time delay interval. During such interval the contacts 39 remain closed so that the pilot light or lights 21 are now lighted and the safety lock 26 is now energized so as to lock the door 16.

Upon the expiration of the predetermined chosen time of the time delay relay 36, the normally closed contacts, 39 are opened thereby de-energizing the pilot light or lights 21 and opening the safety lock 26. The operator of the fire alarm device may then open the door 16 and leave the booth 10.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. In a fire alarm system, the improvement which comprises a fire alarm device, and a mechanism for ensuring the presence of the one who has operated the alarm device at such device for a predetermined length of time, said mechanism comprising an enclosure in which the alarm device is mounted, said enclosure having an opening for the entry and exit of said operator of the fire alarm device, the alarm device being so disposed in the enclosure so that the operator must be within the enclosure before he can operate the alarm device, a door for selectively closing the opening, means responsive to at least the partial open position of the door for preventing operation of the fire alarm device unless the door is closed, and means actuated by the operation of the fire alarm device for locking the door and maintaining the door locked for a predetermined length of time after operation of the fire alarm device.

2. A fire alarm system according to claim 1, wherein said mechanism is electronically actuated, the means for preventing operation of the fire alarm device is an electric circuit means, and the means actuated by the operation of the fire alarm device for locking the door and maintaining the door locked is electrically operated.

3. A fire alarm system according to claim 2, wherein the last-named means unlocks the door after the expiration of said predetermined length of time.

4. A fire alarm system according to claim 3, wherein the means for maintaining the door locked includes a time delay switch means in circuit with the door-locking means.

5. A fire alarm system according to claim 4, wherein the time delay switch means is adjustable, whereby said predetermined length of time may be varied within a desired range.

6. A fire alarm system according to claim 2, comprising a first, door-operated switch having contacts which are closed only when the door is closed, a second switch having normally open contacts which are closed only upon the operation of the fire alarm device, and a sub-circuit having the coil of the door-locking means, the contacts of the first switch and the contacts of the second switch connected in series and interposed therein connected across said two main wires.

7. A fire alarm system according to claim 5, wherein the time delay switch means is a time delay relay having normally closed contacts interposed in said sub-circuit, and a coil which, when energized, opens the contacts of said relay after a predetermined time delay, said coil of the relay being connected to be energized by the closing of the sub-circuit.

8. A fire alarm system according to claim 7, wherein the second switch is a second relay having said normally open second contacts and a coil connected to the fire alarm system so as to be energized upon energization of such system, energization of the coil of the second relay closing said second contacts.

9. In a fire alarm system, the improvement which comprises a fire alarm device, and a actuated mechanism for ensuring the presence of the one who has operated the alarm device at such device for a predetermined length of time, said mechanism comprising an enclosure in which the alarm device is mounted, said enclosure having an opening for the entry and exit of said operator of the fire alarm device, the alarm device being disposed remote from the opening of the enclosure so that the operator must be fully within the enclosure before he can operate the alarm device, a door for selectively closing the opening, electric circuit means for preventing operation of the fire alarm device unless the door is closed, and electrically operated means actuated by the operation of the fire alarm device for locking the door and maintaining the door locked for a predetermined length of time after operation of the fire alarm device and unlocking the door thereafter, the means for maintaining the door locked including an adjustable time delay switch means in circuit with the door-locking means, whereby said predetermined length of time may be varied within a desired range.

10. A fire alarm system according to claim 1, comprising a first, door-operated switch having contacts which are closed only when the door is closed, a second switch having normally open contacts which are closed only upon the operation of the fire alarm device, and a sub-circuit having the coil of the door-locking means, the contacts of the first switch and the contacts of the second switch connected in series and interposed therein connected across said two main wires.

11. A fire alarm system according to claim 10, wherein the adjustable time delay switch means is a time delay relay having normally closed contacts interposed in said subcircuit, and a coil which, when energized, opens the contacts of said relay after a predetermined time delay, said coil of the relay being connected to be energized by the closing of the subcircuit.

12. A fire alarm system according to claim 11 wherein the second switch is a second relay having said normally open second contacts and a coil connected to the fire alarm system so as to be energized upon energization of such system, energization of the coil of the second relay closing said second contacts.

* * * * *